US005415067A

United States Patent [19]

Nielson

[11] Patent Number: 5,415,067

[45] Date of Patent: May 16, 1995

[54] CARPENTER TOOLS AND METHOD OF USE

[76] Inventor: Juan F. Nielson, 85 N. 100 West, Fairview, Utah 84627

[21] Appl. No.: 134,623

[22] Filed: Oct. 12, 1993

[51] Int. Cl.[6] ..... B26D 7/06

[52] U.S. Cl. ..... 83/13; 83/437; 144/242 R

[58] Field of Search ..... 83/425, 437, 477.2, 83/13; 144/242 R

[56] References Cited

U.S. PATENT DOCUMENTS

| | | | |
|---|---|---|---|
| 2,410,467 | 11/1946 | Valentine | 83/437 |
| 2,696,854 | 12/1954 | Woodruff | 83/437 |
| 2,759,503 | 8/1956 | Goldschmidt | 83/425 |
| 4,370,909 | 2/1983 | Jennings | 83/437 |
| 4,399,728 | 8/1983 | Davis | 83/425 |
| 5,016,509 | 5/1991 | Stottman | 83/425 |
| 5,293,800 | 3/1994 | Nunn, Jr. | 83/437 |

*Primary Examiner*—Kenneth E. Peterson

[57] ABSTRACT

A device for pushing the wood past an electric saw blade.

4 Claims, 4 Drawing Sheets

CARPENTER TOOLS AND METHOD OF USE

FIELD OF THE INVENTION

This invention relates to devices for use by carpenters cutting wood by use of an electric table saw. More particularly, the invention relates to tools used by carpenters by cutting wood using an electric table saw for pushing and holding the board in place.

Specifically, the invention provides two devices which may be used singularly or together in the cutting of wood using an electric table saw. Specifically, the invention relates to a device for pushing and holding down the board as it is being cut. Secondly, the invention relates to a device for pushing the board being cut firmly against the fence of an electric table saw.

The device is most useful when cutting narrow boards and when cutting strips from the board because it holds the board flat on the table and helps eliminate the possibility of the saw throwing the narrow cut piece back at the person operating the saw.

PRIOR ART

Electric table saws are equipped with a groove for holding a miter guage and an adjustable fence used as a back guage for the wood to be cut. This invention takes into account both of these items in its use.

In the past, the carpenter who cuts wood on an electric saw does not always have full control of the wood being cut. For example, he sometimes places the wood to be cut against the saw fence and pushes the board by hand past the saw blade. There have been many difficulties with this process in the Past. For example, such a procedure is highly dangerous as the hand comes close to the saw blade. In general, the carpenter sometimes selects another board to push the board to be cut past the saw blade. This is difficult because it allows the board to rise up after it passes through the saw, and in other cases the board to be cut is not properly held against the saw fence and is not cut evenly or properly by such pushing.

If is an object of the present invention, therefore, to provide several devices for use separately or in combination by the carpenter for cutting wood on an electric table saw, said several devices being far more safe and accurate than those use in the past. It is an object of the invention to provide a specially built pushing device for pushing the board to be cut past the saw blade so that it is accurately held in place and is safer than other known techniques. It is a further object to provide a device for holding the board to be cut firmly against the saw fence so that the board is cut evenly and properly.

SUMMARY OF THE INVENTION

It has now been discovered that these and other objects can be accomplished by the new devices of the present invention which provides for the first time a safe and easy method of passing a board past the electric saw blade.

The first new device for pushing the board to be cut through a saw blade comprises (1) a frame of at least the length sufficient to hold the handle described hereinafter, (2) the front and back ends of the frame being bent downward for sufficient length to hold an upright perpendicular board with both sides near said ends being cut out so as to form an opening where an upright perpendicular board end may tit, (3) about 3 to 6 inches of another board placed upright and perpendicular to said frame and in the holes created by the bending of the end, (4) metal strips placed over the ends of the boards in the holes so as to hold the boards tight therein, and (5) a handle attached to the top of the frame so as to be able to push the frame forward against the end of any board being passed against the said blade and the saw fence. The new device is operated by pushing the device against the end of the board being cut and continuing to push until the board has been cut by the saw blade. This may mean that the boards placed at the end of the frame are cut by the saw but they are replaceable and other small boards may be placed in the end of the frame so that they will be ready for use the next time the device is operated.

It has been found that by the use of the above-described device, one can push the board to be cut past the saw blade without any danger to the operator. In addiction, the board is held firmly and the cut is done evenly by the use of the pusher board as noted above.

The second help to the carpenter relates to the device for holding the board against the saw fence. It has been found that the board to be cut may be held tightly against the back board so that the board will be cut evenly by the use of the new device of the invention, comprising (1) a board strip which fits down in the groove on the top of the electric saw blade table, (2) a block attached to the said board strip with a spring loaded locking device on the underside thereof with a knob controlling said locking device, (3) a metal spring strip attached to the side of said block, which side is towards the saw blade, a holding block at the far end of the metal strip pressed firmly against the board being cut, and (4) means for holding the block firmly to the metal strip. It has been found that by holding the block firmly against the board to be cut that it is held against the saw fence all the time so that the finished board is cut evenly by the saw blade.

The first device or pusher board is most useful when cutting narrow boards and when cutting thin strips from the board because it holds the board flat on the table and helps eliminate the possibility of the saw throwing the narrow cut piece back at the person operating the saw.

This is much safer than other methods because the operator can both hold the board down on the table and completely push the board through the saw without the danger of having his hands close to the saw Although the boards in the pusher are replaceable they can usual be used many times before their replacement is necessary.

The second device which holds the board to be cut against the saw fence is a very useful device. This device is secured in place in the groove on the saw table as noted above. The spring tension arm is adjustable to accommodate a board the width of the distance between the saw fence and the groove in the table. In using this device, one pushes the board being cut firmly against the saw fence, and then the knob is tightened down so that the spring loaded board held against the board is tightened down. By holding the board so firmly against the fence one can then push the board through the saw blade by using the pushing board as described above.

This is especially useful to the operator when cutting long narrow boards when he must stand back from the saw and direct the board into the saw.

DESCRIPTION OF THE DRAWINGS

With reference to FIG. 1 which is the board pusher, no. 10 and 11 are pieces of wood pushed up into the top frame 14. Pieces of metal placed up at the top to make the board 10 secure is noted as item 12 with the end of the frame bend over at 16. At the other end the piece of metal placed at the top of the board to hold it in place is 13 with the end of the frame bent over to hold the board as 15. The handle of the pusher is shown as 17, and held on the frame extension 18 by bolts 23 with the brace as 19 to hold up the handle 18 and 19 are held on the frame by use of soldering means and identified as 18A and 19A and item 20 is the board being pushed and 21 is the top of the table saw.

With reference to FIG. 2 which is a frontal view of the board pusher shown in FIG. 1, the front of the board is shown as 11, the frame as 14, the frame extension as 18, holding handle 17 by means of the screws or bolts 23. The cuts in the wood ends made by the saw at previous times are shown as 22, the top of the saw as 23 and the board being cut as 38.

With reference to FIG. 3 which is a top frontal view of the board holder, the groove in the saw table is shown as 37, the metal strip attached to the bottom of the board holder is shown as 24 with the screw to hold the board holder in place and screwed down to the bottom of the groove is shown as 25. The metal spring is shown as 28 with the block holding the board is shown as 30 and held in place by screw 31. The base of the board holder is shown as 27, the knob which controls the locking device under the knob is shown as 26. With reference to FIG. 4 which is a bottom view of the board holder, the metal strip which fits into the groove on the table saw is shown as 24, the nut which holds the strip in the groove is shown as 25, the locking strip is shown as 27A and the screw which draws the block tight in the locking strip is shown as 27B the metal spring which holds the rounded block against the wood is shown as 28, the block of wood as 30, held by bolt or screw 31. The block which holds the strip which is placed in the groove is shown as 26A.

With reference to FIG. 5 which shows how the holder is placed against the board, the board is shown as 21, the spring holding the block 30 against the wood being cut is 28, which is held on the block by screw 36, the spring is held in the main block at 28, the groove in the table is 37, the screw which holds the metal strip in the groove is shown as 25, the main block is 27, the knob which locks the block in place is shown as 26, with the metal strip fitting into the groove and being screwed down is shown as 24.

With reference to FIG. 6, the electric saw table is shown as 40, the board being cut as 41, the saw blade as 42, the strip in the saw table is 45, the knob tightening the pusher back against the board as 44 and the pusher block as 43.

Figure 1:
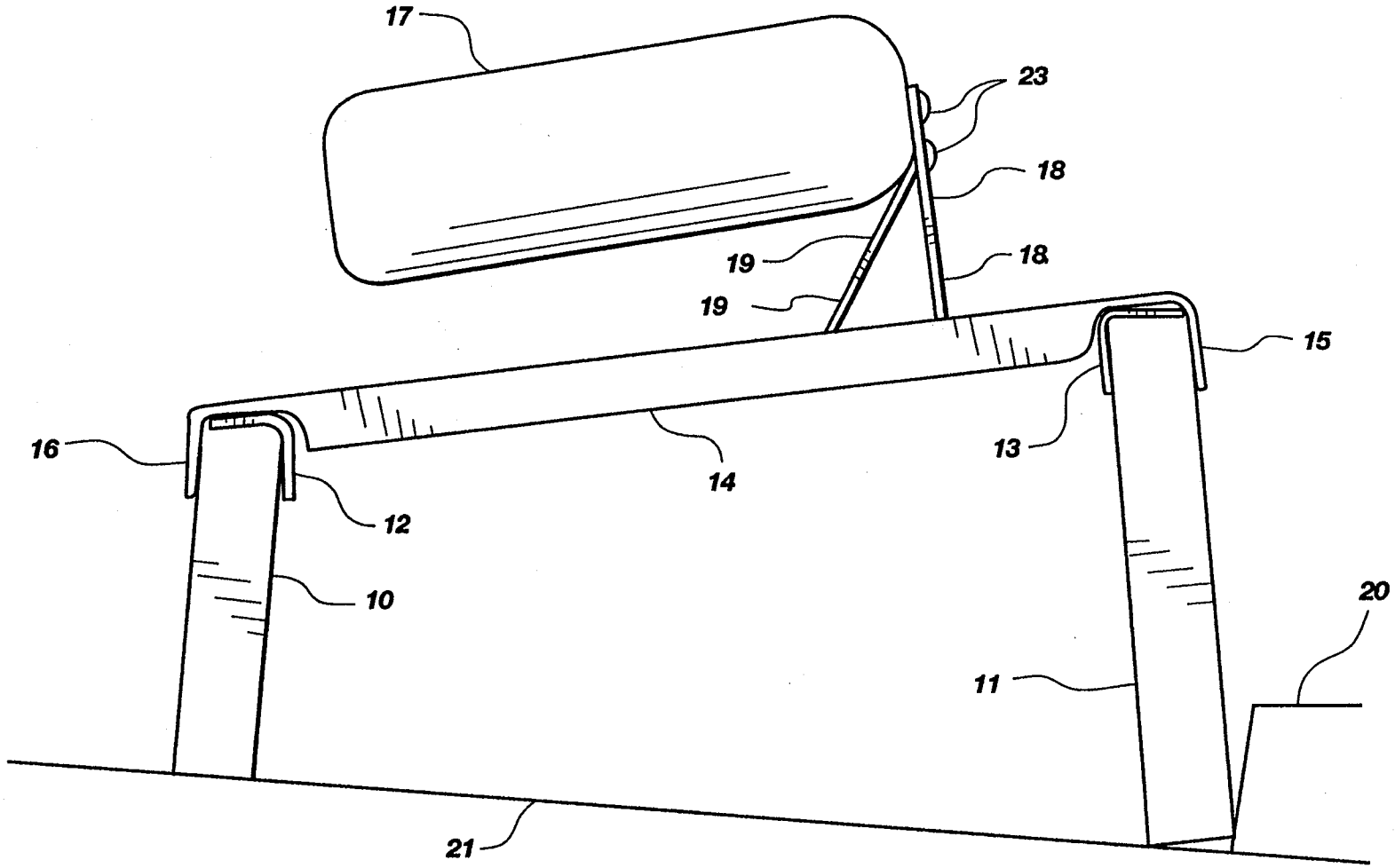
FIG. 1 is a side view of the board pusher itself.
Figure 2:
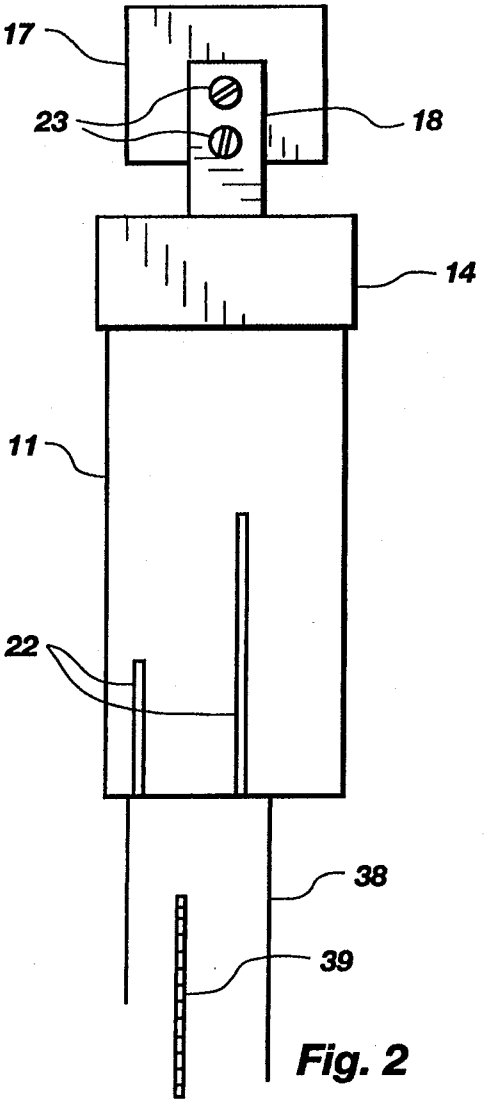
FIG. 2 is a frontal view of the same board pusher as in FIG. 1.

The two devices of the present invention can be used to cut any type of wood on any type of table saw having a groove so that the device holding the board can be placed. The device for pushing the board past the saw blade can be use for pushing any type of wood through the saw blade.

The frame on the pusher board may be of any type, such as wood, metal and the like, but is preferable metal. The pusher is in the form of a inverted U shape with the length preferably 4 to 8 inches and the turned down sides may be from $\frac{1}{2}$ to $\frac{3}{4}$ inches in width. The preferred frame being of sheet metal and being about 8 to 9 inches in length with about $\frac{3}{4}$ inch of the sides.

The downwardly facing U-shaped brackets are about the width of the wood to be placed therein. In general this is about $\frac{1}{2}$ to $\frac{3}{4}$ inches in width.

The pieces of board placed in the cut openings may be of any length but are preferably from 3 to 6 inches in length. The board at the front and that at the back may be of different length as desired. These boards may be replaced as desired if they have many cuts through after several pushings of the board past the saw blade.

The handle on the-frame may be of any type but is preferable one raised above the frame as shown in the drawing and held by a bent support as shown in the drawing. The handle may be of wood, metal or of any type as long as it supports the frame as noted above.

Figure 4:
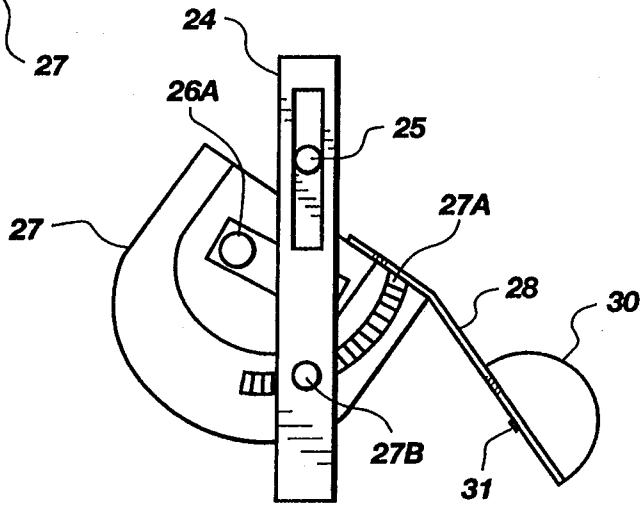
FIG. 4 is a bottom view of the board holder as in FIG. 3.
Figure 5:
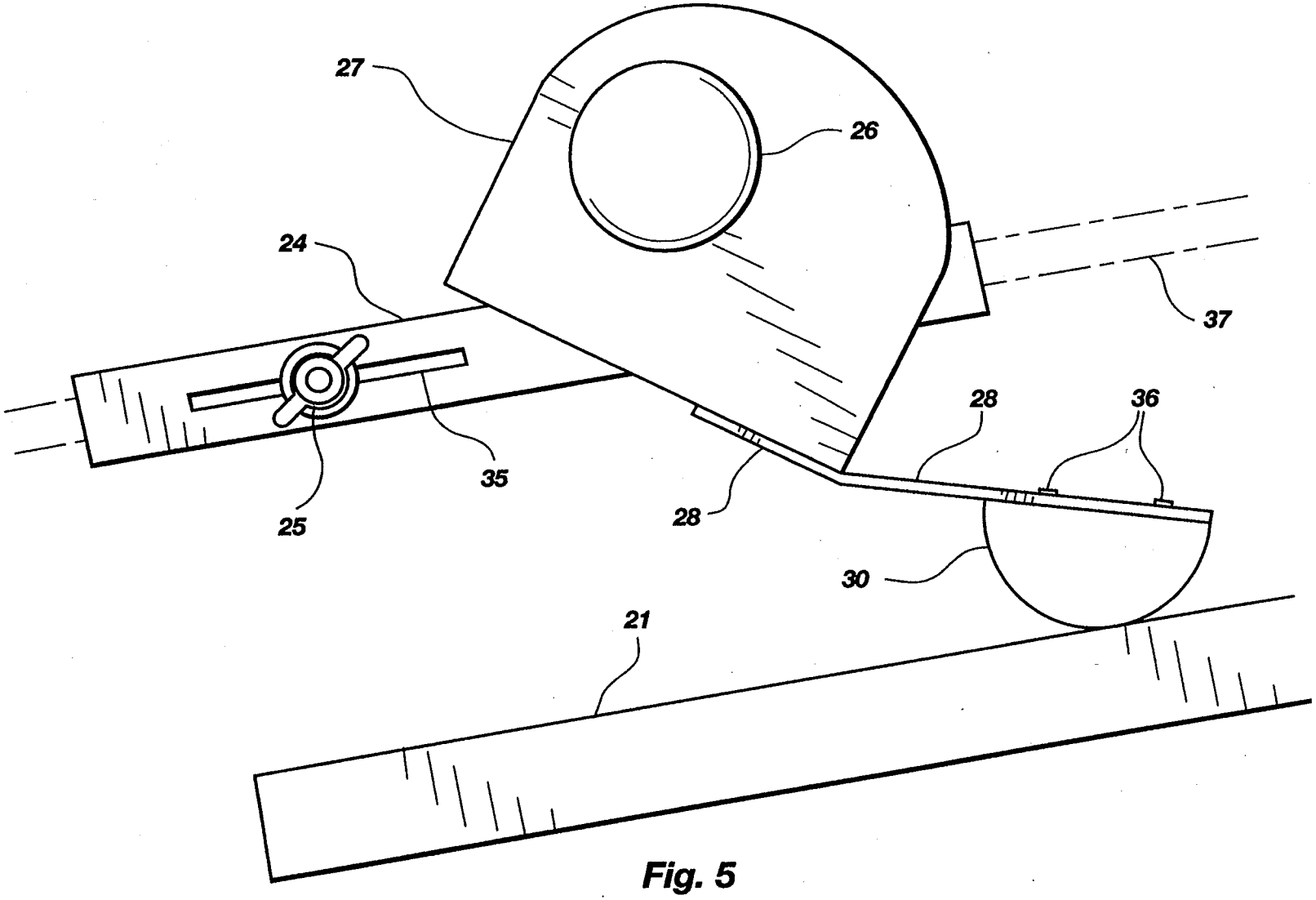
FIG. 5 is a top view of the board holder as it is adjusted to hold against a board placed in the saw.
Figure 6:
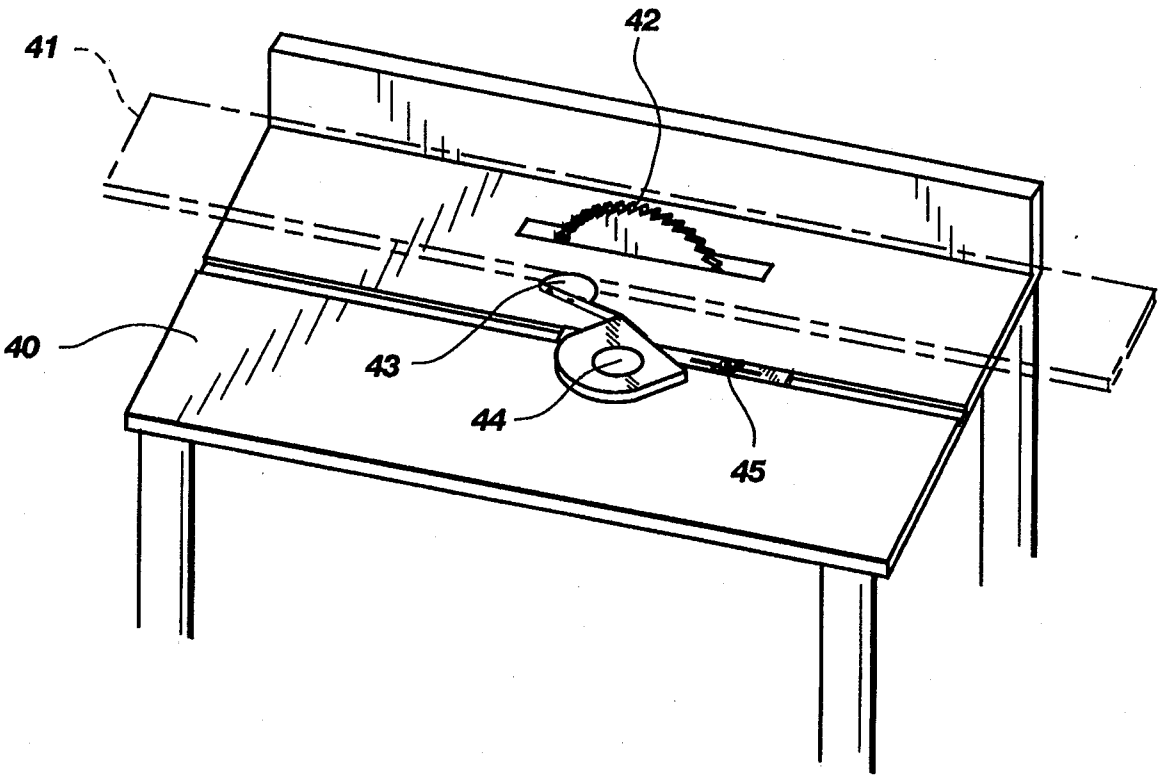
FIG. 6 is a diagrammatic sketch of an electrical saw with a fence placed thereon and held by the new board holder of the present invention.

The device of the present invention used to hold the board against the backboard of the saw table is shown in FIG. 4 and its use in FIG. 6. The board strip that fits into the groove of the table may be of any construction, but is preferably of wood so that the nut on the top as shown as 25 in FIG. 5 can be easily placed and easily screwed down-to hold every thing in place.

Figure 3:
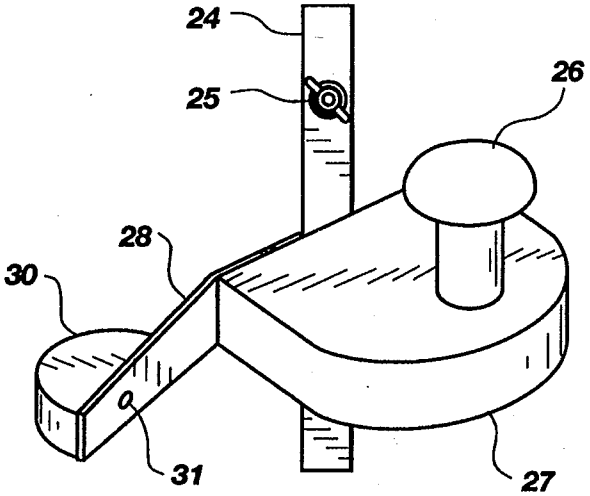
FIG. 3 is frontal view of the board holder.

The block attached to the strip in the groove may be of any size or of any construction but is generally as shown in FIG. 3 with a locking strip placed on the underside.

The spring means that is attached to the inner side of the block and holds the holding block at the end, may be of any type and construction. In general, the spring is a piece of spring metal to which is attached to the blocking piece of wood. The length of the spring means may vary but is preferably between 3 to 6 inches depending on the application intended.

The block of wood at the end of the spring to hold against the wood being cut may be of any shape or size and of any construction but preferably has a rounded end and a flat side being attached to the spring means.

The knob on top of the block used to lock the piece in place may be of any type or construction but is preferably of the type shown in the drawings. It is attached to the piece in the groove and can be rotated to set the spring firmly against the piece of wood being cut.

The devices may be used on any type of electric table saw.

I claim as my invention:

1. A device for pushing a workpiece to be cut past an operating saw blade on a saw table, said device comprising a frame having a length, a top, a bottom, a front end, a back end and a handle attached to the top along the length thereof, the front and back ends having bent down portions to form perpendicularly extending flanges, said front and back ends also having metal strips attached adjacent said flanges so as to jointly form two downwardly facing U-shaped brackets, each of which holds a top end of a board, such that a bottom end of each board may be placed against said saw table to push the workpiece past the saw, thus allowing the saw to cut thru the boards while keeping an operator's hands a safe distance from the saw.

2. The device as in claim 1 wherein the frame is made of metal.

3. The device as in claim 1 wherein the handle is made of wood.

4. A method for pushing a workpiece to be cut past an operating saw blade on a table saw which comprises pushing the handle of the device of in claim 1 against the front end of the workpiece to be cut and allowing the saw blade to cut through the workpiece to be cut as well as the bottom of the two perpendicular boards placed at the front and rear ends of the frame.

* * * * *